US010588205B1

(12) United States Patent
Mays, II et al.

(10) Patent No.: US 10,588,205 B1
(45) Date of Patent: Mar. 10, 2020

(54) ISOLATED DIGITAL CONTROL DEVICE FOR LED DRIVER USING NFC TECHNOLOGY

(71) Applicant: Universal Lighting Technologies, Inc., Madison, AL (US)

(72) Inventors: Stephen D. Mays, II, Madison, AL (US); Reggie Anglin, Madison, AL (US); John J. Dernovsek, Madison, AL (US); Scott Price, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 0 days.

(21) Appl. No.: 16/257,670

(22) Filed: Jan. 25, 2019

Related U.S. Application Data

(60) Provisional application No. 62/622,360, filed on Jan. 26, 2018.

(51) Int. Cl.
*H05B 33/08* (2006.01)
*H05B 41/285* (2006.01)
*H05B 37/02* (2006.01)

(52) U.S. Cl.
CPC ..... *H05B 37/0272* (2013.01); *H05B 33/0809* (2013.01); *H05B 33/0845* (2013.01); *H05B 33/0887* (2013.01); *H05B 41/2851* (2013.01)

(58) Field of Classification Search
CPC . H05B 37/0272; H04L 41/0809; H04L 41/20; H04B 5/0031; H04B 5/0068; G06F 8/61
See application file for complete search history.

(56) References Cited

U.S. PATENT DOCUMENTS 5,039,914 A 8/1991 Szuba
5,089,751 A 2/1992 Wong et al.
(Continued)

FOREIGN PATENT DOCUMENTS

AU 2015101242 A4 * 10/2015
EP 2306791 A2 4/2011
WO 2014013377 A2 1/2014

OTHER PUBLICATIONS

NXP Semiconductors: NT3H1101/NT3H1201, NTAG I2C—Energy Harvesting Type 2 Tag with field detection pin and I2C Interface, Rev. 3.3—Jul. 15, 2015, 265433, Product data sheet Company Public.

*Primary Examiner* — Raymond R Chai
(74) *Attorney, Agent, or Firm* — Patterson Intellectual Property Law, P.C.; Gary L. Montle

(57) ABSTRACT

A luminaire otherwise lacking connectivity is provided hereby with an isolated method for connecting to a lighting control system. The luminaire comprises an NFC-equipped LED driver having a first antenna. A digital control device with a second antenna is permanently or semi-permanently mounted in or on the luminaire wherein the second antenna is positioned in operable proximity with the first antenna. The digital control device includes a first transceiver in communication with the external device and a first controller to receive and store device configuration data from the external device in volatile memory associated with a second transceiver linked to the first antenna. A controller associated with the LED driver selectively obtains the device configuration data from the volatile memory via the NFC field, and generates output current reference signals for regulating the output current from the LED driver, said reference signals corresponding to the device configuration data.

16 Claims, 7 Drawing Sheets

(56) References Cited

U.S. PATENT DOCUMENTS

| | | | | |
|---|---|---|---|---|
| 6,144,539 | A | 11/2000 | Konopka et al. | |
| 6,204,613 | B1 | 3/2001 | Hesterman | |
| 6,356,027 | B1 | 3/2002 | Zhang et al. | |
| 7,333,353 | B2 | 2/2008 | Yin | |
| 7,750,577 | B2 | 7/2010 | Nerone et al. | |
| 8,654,485 | B1 | 2/2014 | Koehler | |
| 9,693,411 | B1 | 6/2017 | Xiong et al. | |
| 9,723,667 | B1 | 8/2017 | Xiong et al. | |
| 10,128,101 | B2 | 11/2018 | Goscha et al. | |
| 2009/0079357 | A1 | 3/2009 | Shteynberg et al. | |
| 2010/0102747 | A1 | 4/2010 | Ilyes et al. | |
| 2010/0181935 | A1 | 7/2010 | Wu | |
| 2011/0145476 | A1* | 6/2011 | Hulbert | G06F 12/1009 711/103 |
| 2011/0285311 | A1 | 11/2011 | Yang et al. | |
| 2012/0249001 | A1 | 10/2012 | Okubo et al. | |
| 2013/0082604 | A1 | 4/2013 | Williams et al. | |
| 2014/0117868 | A1 | 5/2014 | Lopez et al. | |
| 2014/0125241 | A1 | 5/2014 | Elferich et al. | |
| 2014/0145607 | A1 | 5/2014 | Goscha et al. | |
| 2014/0253562 | A1 | 9/2014 | Yaras | |
| 2015/0296598 | A1* | 10/2015 | Haid | H05B 37/0272 315/291 |
| 2016/0165702 | A1* | 6/2016 | Lai | H05B 37/0272 315/201 |
| 2016/0242253 | A1 | 8/2016 | Bhagwat et al. | |
| 2016/0353002 | A1* | 12/2016 | Clark | H04N 5/2251 |
| 2017/0041188 | A1* | 2/2017 | Panchapakesan | H04L 41/0809 |
| 2018/0092186 | A1* | 3/2018 | Stuby, Jr. | H05B 37/0227 |
| 2019/0230773 | A1* | 7/2019 | Kamp | G05B 15/02 |

* cited by examiner

ISOLATED DIGITAL CONTROL DEVICE FOR LED DRIVER USING NFC TECHNOLOGY

CROSS-REFERENCES TO RELATED APPLICATIONS

This application claims benefit of U.S. Provisional Patent Application No. 62/622,360, filed Jan. 26, 2018, and which is hereby incorporated by reference.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

BACKGROUND

The present invention relates generally to lighting devices such as light emitting diode (LED) drivers. More particularly, an embodiment of an invention as disclosed herein relates to an electrically isolated method for digitally dimming, configuring and updating the firmware of a programmable lighting device through wireless communication and volatile memory.

Lighting devices such as light emitting diode (LED) drivers frequently have their operating parameters configured before shipping to customers for installation. Various operating parameters of the LED driver are typically reconfigured at other stages of application, as for example when a driver is first removed from its packaging it may be desired to apply a default configuration to satisfy the needs for most of the LED drivers at a particular installation. Further, once a new driver is installed with other LED drivers in a luminaire, it may be required that all the drivers in the luminaire or series of luminaries receive a configuration unique to their installation.

One way for end users or LED light fixture manufacturers to be able to configure operating parameters of LED drivers in a safe, quick, and easy way is to load configuration parameters into the non-volatile storage memory medium, such as flash memory, of an integrated circuit (IC) for a near-field communication (NFC) tag in the LED driver while the LED driver itself is unpowered, through the use of a configuration device equipped with a radio-frequency identification (RFID) transceiver IC and antenna.

For LED drivers equipped with NFC technology, or otherwise implement RFID processes, it may be desired to provide isolated digital control, including two-way communication for activities such as dimming and data reporting. The two-way communication with the driver can be accomplished via an RF field, generated by the digital control device, by coupling the digital control device to the LED driver.

Known arrangements to link LED drivers to external dimming commands and/or data reporting include 0-10V analog dimming control (0-10V), digital addressable lighting interface (DALI), two-wire serial powered bus (TPSB), and digital multiplex (DMX). However, none of these interfaces naturally provide isolation. It is common for a given driver's implementation of DALI to include isolation, but this must be specifically designed for the driver and is not inherent to such systems. It is known for 0-10V and TPSB to be referenced to a floating ground, but once again the isolation must be included in the overall design. Of the aforementioned arrangements, only DALI and TPSB provide two-way communication.

Accordingly, it would be desirable to provide a luminaire that otherwise lacks connectivity with an isolated digital control device and method to connect to a larger lighting control system. It would further be desirable for such a novel arrangement to be conveniently and reliably mountable in association with the luminaire.

BRIEF SUMMARY OF THE INVENTION

According to one embodiment of a luminaire as disclosed herein, a driving circuit such as for example an LED driver is configured to convert AC mains input power into an output current for driving a lighting load and comprises a first antenna such as for example an NFC antenna and an associated interface. A digital control device comprises a second antenna and is mounted wherein the second antenna is positioned in operable proximity with the first antenna, the digital control device further comprising one or more transceiver circuits configured to receive and store device configuration data from an external device. A controller associated with the driving circuit is configured to obtain device configuration data from at least one of the one or more transceiver circuits via the operably linked first and second antennae, and to generate output current reference signals for regulating the output current from the driving circuit, said reference signals corresponding to the device configuration data.

In another embodiment, the one or more transceiver circuits comprise a first transceiver circuit coupled to one or more input terminals to communicate with the external device, and a second transceiver circuit coupled to the second antenna and comprising a volatile memory interface configured to store the device configuration data, wherein the controller is configured to receive the device configuration data from the second transceiver circuit via the volatile memory interface and the operably linked first and second antennae.

In another embodiment, the digital control device comprises a second controller configured to process device configuration data received from the external device for selective storage in volatile memory of the second transceiver circuit, and to process reply data received from the controller associated with the driving circuit for selective transmittal to the external device.

In another embodiment, the digital control device comprises a housing detachably mounted in association with the luminaire, the second antenna positioned in operable proximity with the first antenna. The housing of the digital control device may comprise at least a fitted portion corresponding to at least a portion of a housing for the driving circuit, wherein upon engagement of the respective portions the first and second antennae are positioned in operable proximity.

In another embodiment, the digital control device comprises a second controller configured to process device configuration data received from the external device for selective storage in volatile memory of the one or more transceiver circuits, and to process reply data received from the controller associated with the driving circuit for selective transmittal to the external device, wherein the digital control device further comprises a power converter coupled to one or more input power terminals and configured to supply output power to the one or more transceiver circuits and the second controller.

The driving circuit and the power converter of the digital control device may be configured to share mains input power. Alternatively, the driving circuit and the power converter of the digital control device may be configured to share input power from an auxiliary power supply. Still further alternatively, the power converter of the digital control device may be configured to receive a lighting load driving current from the driving circuit.

In another embodiment, the one or more transceiver circuits and the second controller are configured to transfer and receive device configuration data in a bidirectional negotiation with the external device.

In another embodiment, the one or more transceiver circuits and the second controller are configured to receive push updates of configurable parameters associated with the device configuration data from the external device.

In another embodiment, the one or more transceiver circuits and the second controller are configured to transmit to the external device real time diagnostic and/or power reporting data received from the driving circuit via the operably linked antennae and stored via the volatile memory interface.

According to an exemplary embodiment of a method as disclosed herein for providing isolated digital control for a luminaire comprising a light emitting diode (LED) driver having a first antenna, a digital control device comprising a second antenna may be permanently or semi-permanently mounted wherein the second antenna is positioned in operable proximity with the first antenna. Device configuration data is delivered from an external device to the digital control device, wherein the device configuration data is received and stored in the digital control device. At least a portion of the device configuration data is selectively delivered from the digital control device to a controller associated with the LED driver via the operably linked first and second antennae. An output current from the LED driver is provided through an associated LED lighting load, the output current regulated based at least in part on the device configuration data.

In an embodiment of the method, the device configuration data is received and stored in a volatile memory interface associated with the digital control device.

In another embodiment of the method, device configuration data received from the external device is processed for selective storage in volatile memory of the digital control device, and reply data received from the LED driver is processed for selective transmittal to the external device.

DETAILED DESCRIPTION OF THE INVENTION

Figure 1:
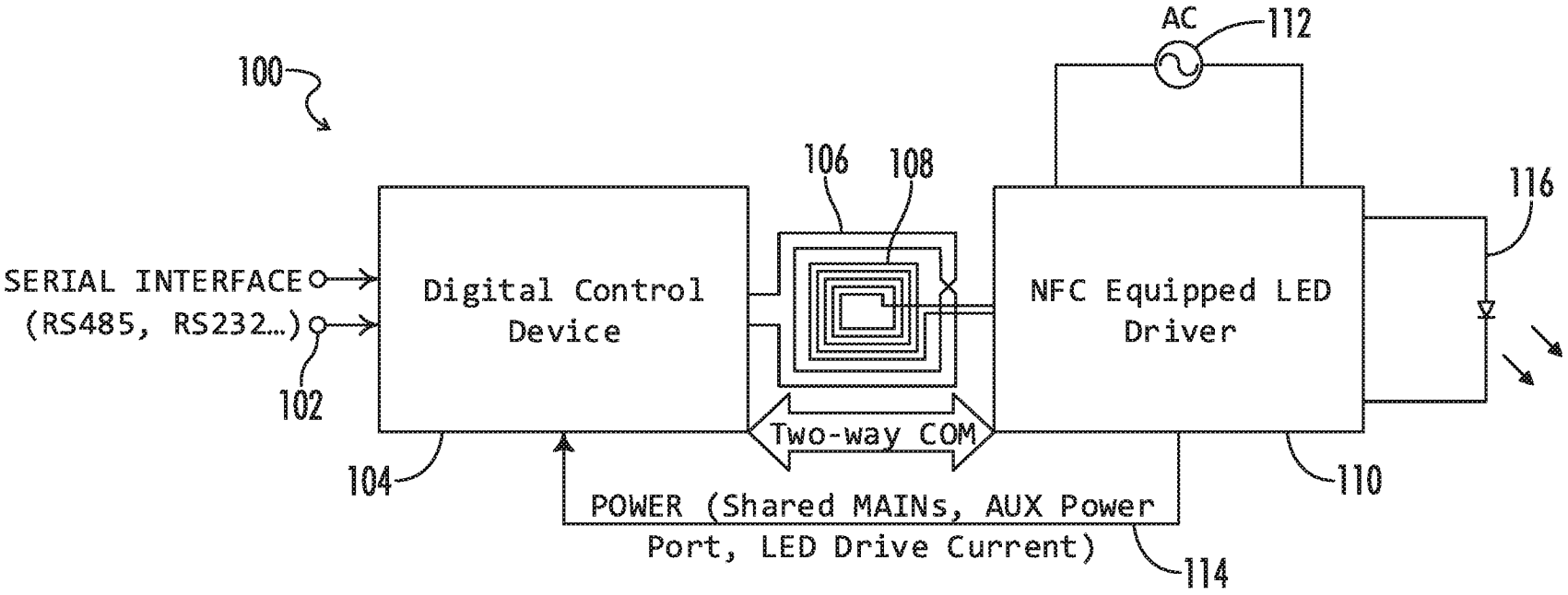
FIG. 1 is a block diagram representing an embodiment of a luminaire as disclosed herein, with a serial interface to an external device.

Referring generally to FIGS. 1-9, various exemplary embodiments of an invention may now be described in detail. Where the various figures may describe embodiments sharing various common elements and features with other embodiments, similar elements and features are given the same reference numerals and redundant description thereof may be omitted below.

Figure 2:
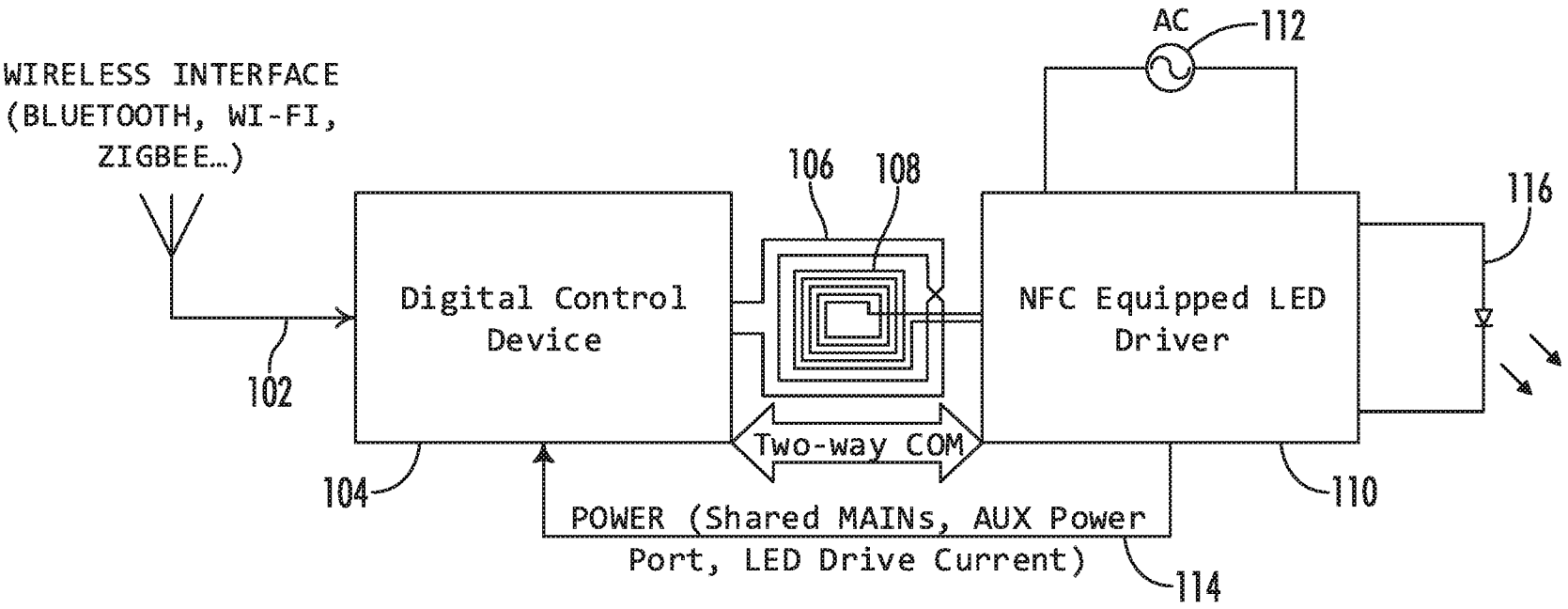
FIG. 2 is a block diagram representing another embodiment of a luminaire as disclosed herein, with a wireless interface to an external device.

As represented in FIGS. 1 and 2, an exemplary embodiment of a luminaire 100 as disclosed herein includes a driving circuit 110 such as a light emitting diode (LED) driver equipped with wireless communications capability, such as for example near field communications (NFC) capability, and further including a power stage (not shown) configured for powering a light source 116 such as an LED load. The driving circuit is coupled to an AC mains power input 112 and also includes an antenna or coil 108 for selective bidirectional communications with a corresponding antenna 106 for a digital control device 104 which is also fixed to or in association with the luminaire. Either or both of the antennae in an embodiment may simply be formed by a plurality of turns on a multi-layer printed circuit board (PCB) that is outside of—or simply not fully encased within—the metal housings of their respective devices. Output power provided from the driving circuit to the light source may be regulated at least in part by a controller and/or one or more drivers which produces control signals to one or more switching elements and regulate an operating frequency thereof. The control signals from the controller/driver circuitry may for example be based upon a number of factors, such as preset values, load conditions, and the like, but also based at least in part on dimming control signals which may be provided via the NFC interface, themselves based on dimming input signals received from an external dimming device.

Data sent to the LED driver 110 from the digital control device 104 is received by the digital control device via either a wireless radio frequency (RF) signal as represented in FIG. 1, such as Bluetooth Low Energy (BLE), Zigbee, Wi-fi, etc., or a wired serial connection as represented in FIG. 2, such as Digital Addressable Lighting Interface (DALI), RS232, RS485, etc. The data received from one of these external interfaces may be buffered by an internal processor and repeated by an RFID transceiver integrated circuit (IC) via the RF link to the LED driver. The data commands and queries received by the LED driver are parsed and acted on, for example to generate or regulate output current through the one or more LEDs 116 coupled thereto. A controller associated with the LED driver may be configured for example to obtain device configuration data via the operably linked first and second antennae, and to generate output current reference signals for regulating the output current from the LED driver, said reference signals corresponding to the device configuration data. The device configuration data may for example describe a desired lighting (dimming) level, and/or various device parameters necessary for proper generation of an output current to the light source corresponding to the desired lighting level. Exemplary such parameters (or values associated with said parameters) may further include minimum and maximum output currents, dimming curve (e.g., linear, logarithmic), dimming control voltages, on/off states for enabling or disabling various programmable features such as lumen maintenance, a threshold voltage for triggering on/off functions, and the like.

Figure 3:
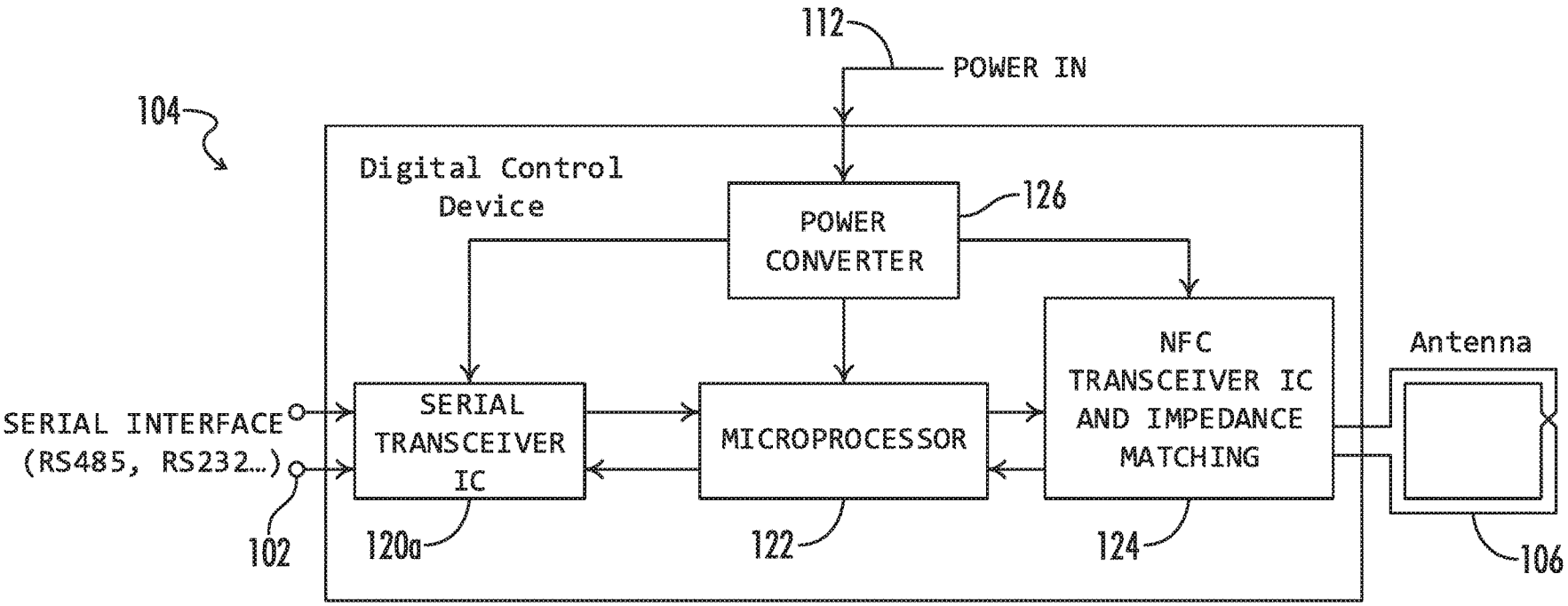
FIG. 3 is a block diagram representing exemplary detail for the digital control device of the embodiment in FIG. 1.
Figure 4:
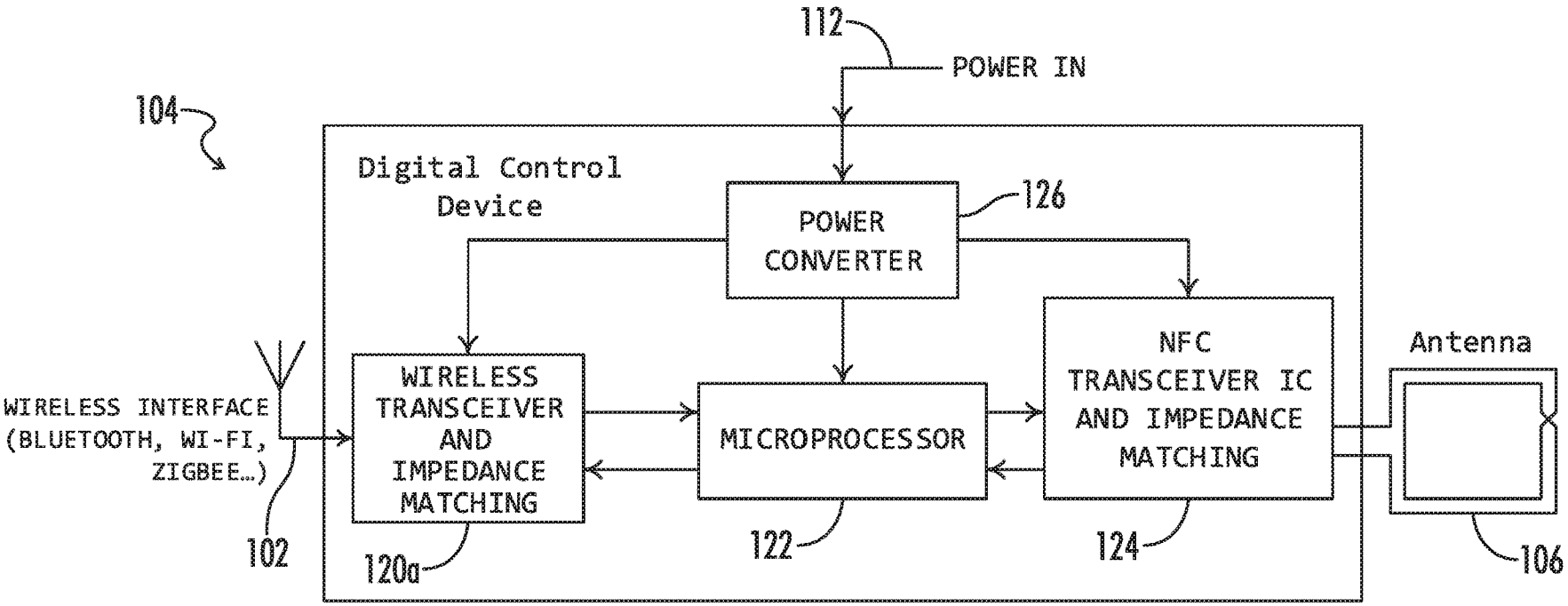
FIG. 4 is a block diagram representing exemplary detail for the digital control device of the embodiment in FIG. 2.

Referring next to FIGS. 3 and 4, exemplary embodiments of the digital control device 104 are represented. The digital control device in each embodiment comprises a first transceiver, which could be a serial transceiver IC 120*a* coupled to one or more serial input terminals 102 (as shown in FIG. 3), or a wireless device 120*b* linked via a wireless interface 102 (as shown in FIG. 4). An external device (not shown) may be connected to or paired to the digital control device via the wired interface or the wireless interface to provide a command or query that is received by the first transceiver.

The serial transceiver IC or wireless device is connected to an internal controller 122 that collects, accumulates and processes the data received via the first transceiver. The controller then communicates with and/or repeats the data to a second transceiver 124 (e.g., RFID transceiver IC) that will drive an antenna 106 through an impedance matching network. For the sake of isolation when using a wired serial interface, such as RS485 or RS232, opto-isolators (not shown) can be used between the serial transceiver IC and the controller. Any reply from the NFC-equipped driver is also accumulated and processed by the controller and, if required, returned to the external device.

With the digital control device 104 configured accordingly, data may be sent bidirectionally in the form of commands from the digital control device and confirmation responses from the driving circuit 110, and also in the form of queries from the digital control device and replies from the driver. It is conventionally known to use NFC protocols for two-way communication to store data in non-volatile storage media, such as Electrically Erasable Programmable Read-Only Memory (EEPROM) and/or FLASH memory, to be retrieved later. However, an embodiment of a digital control device 104 as disclosed herein comprises an RFID IC that includes volatile memory, such as static random-access memory (SRAM), and incorporates the volatile memory for real-time two-way communication. Such an arrangement is demonstrably faster than the conventional reliance on non-volatile memory for the interface. By way of comparison, it may take 4.5 mS to write 16 bytes of data to the EEPROM of an RFID IC, and only take 0.4 mS to write 16 bytes of data to the SRAM of the same or equivalent IC. Another considerable advantage of the volatile memory storage of the digital control device pertains to the continuous data transfer needed for continuous digital dimming interfaces. As the digital control device as disclosed herein is permanently or semi-permanently mechanically connected to the NFC antenna on the LED driver, dimming commands may for example be transmitted to the LED driver every 200 milliseconds, wherein the non-volatile memory in certain exemplary ICs would reach its 500 k write endurance limit in about 83 days of run time. Implementation of volatile memory substantially eliminates this undesirable event.

Via the NFC interface, the digital control device 104 clocks commands and/or queries into SRAM of the RFID IC 124. The driver 110 will extract the contents of the RFID IC's SRAM and respond by clocking its response into the same SRAM. In a similar fashion, via the NFC interface the digital control device will extract the contents of the SRAM in the RFID IC and, if necessary, repeat the driver's response to a system level controller (not shown).

In an embodiment, the digital control device 104 as disclosed herein may transfer and receive device configuration data in a bidirectional negotiation with the external device (not shown). For example, the external device may only transmit device configuration data as needed when the bidirectional negotiation establishes that an available configuration data set differs from a current configuration data set associated with the driving circuit 110, or the digital control device may provide a negative acknowledgement if a requested configurable parameter is outside the operating limits of the associated LED driver. Alternatively, the digital control device may receive push updates of configurable parameters associated with the device configuration data from the external device, wherein the parameters may for example be processed and delivered to the driving circuit controller as needed.

In an embodiment, the digital control device may accumulate and/or calculate and transmit to the external device real time diagnostic and/or power reporting data received from the driving circuit via the operably linked antennae and stored via the volatile memory interface. The digital control device may be configured to measure, calculate, and/or estimate power consumption values associated with the digital control device and/or the driving circuit, and to continuously or selectively report the power consumption values to the external device.

In various embodiments as contemplated herein, power for the digital control device 104 may be provided by sharing the AC mains input power, via an auxiliary power supply, or shared LED drive current. The digital control device as disclosed in FIGS. 3 and 4 accordingly includes internal power regulation circuitry 126 to transform the available energy into a power source appropriate to the remaining components 120, 122, 124 of the digital control device. Various exemplary embodiments of the power converter can be any device that can convert the input voltage to one or more DC levels appropriate for the electronics, such as a linear regulator or a switching converter.

One of skill in the art will appreciate that the NFC interface provides electrical isolation between the digital control device 104 and the driving circuit 110. Typical dimming interfaces, such as analog interfaces and DALI, are wired interfaces which can damage either the driver or the dimming interface if isolation between the dimming source and the driver is not provided. The system as disclosed herein takes advantage of the isolation naturally provided by the NFC interface to avoid damaging either the driver or the digital dimming interface even if the digital control device is powered by a source that could be otherwise damaging.

To transfer data, the antenna 106 of the digital control device 104 and the antenna 108 of the NFC-equipped driver 110 must be operably proximate with respect to each other. The term "operably proximate" as used herein may generally refer to an appropriate alignment of the respective antennae, wherein for example the antennae must be in proximity with each other, both antennae must be co-planar, and the extents of the antenna of the NFC equipped driver must be within the extents of the antenna of the programming and configuration device. In a preferred embodiment of a luminaire as disclosed herein, the digital control device is mounted to remain as a permanent or semi-permanent fixture to provide control for the duration of the driver's life, wherein this functional arrangement must be maintained.

To maintain this mounting arrangement, a housing 130 for the digital control device 104 is designed to be at least semi-permanently mounted in a luminaire 100 with the NFC equipped driver 110 or on the NFC equipped driver so as to correctly align the antennae 106, 108. One skilled in the art can identify numerous methods to mount the invention so as to meet the alignment criteria. For example, the housing can be adhered to the side of the driver or to an inner wall of the luminaire. In another example, the housing can employ a magnet to hold itself to the steel driver housing or the steel luminaire. Another option is to design the housing around the shape and geometry of the driver and employ a clip that securely connects to the driver housing.

Figure 5:
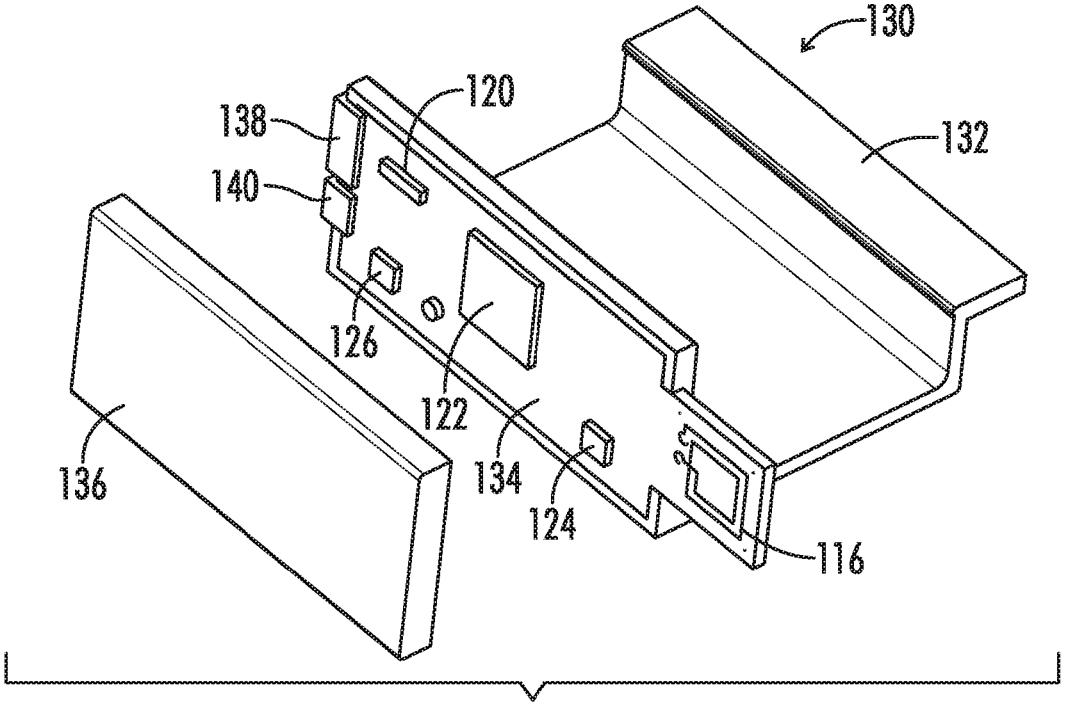
FIG. 5 is an exploded isometric view of a printed circuit board and housing for a digital control device according to an embodiment as disclosed herein.
Figure 6A:
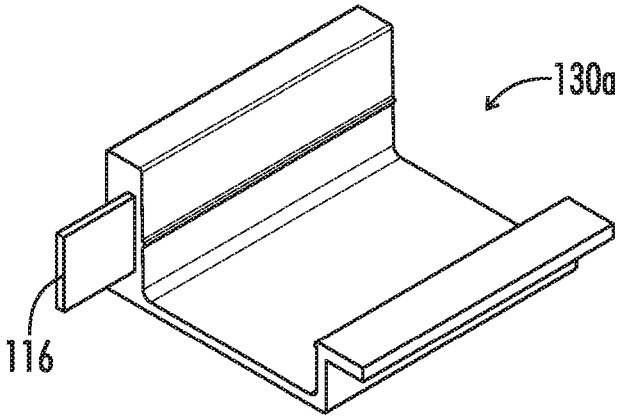
FIGS. 6*a* and 6*b* are separate isometric views of an exemplary digital control device housing with wired interface.
Figure 6B:
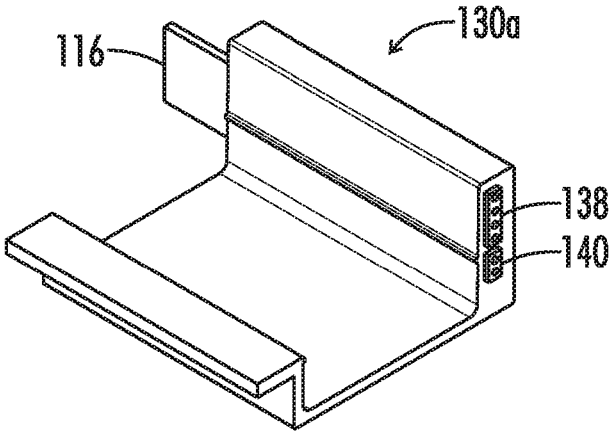

Referring next to an exemplary embodiment as illustrated from varying perspectives in FIGS. 5, 6*a*, and 6*b*, the digital control device 104 includes a printed circuit board 134 mounted in a housing 130 that can clip onto the lid of a representative driver that employs, e.g., NFC protocols. The illustrated embodiment features a connector 138 that can accept electrical connections for a wired interface to be buffered by a first transceiver IC 120.

To power the invention, power from AC input mains or shared from the NFC equipped driver can be connected to the digital control device via an input power connector 140 to be processed and distributed by a power converter IC 126. Proximate to the power converter IC is a representative magnetic, which may typically be an integral component of the power conversion stage.

To protect the internal circuitry, a housing lid 136 may be adhered, screwed, or snapped into place on the housing 130. To ensure that the housing remains securely connected to the driver when so positioned, the housing may include a small flange 132 or ledge that will snap into place at the base of the lid of the NFC equipped driver, as further described and illustrated below.

Figure 7:
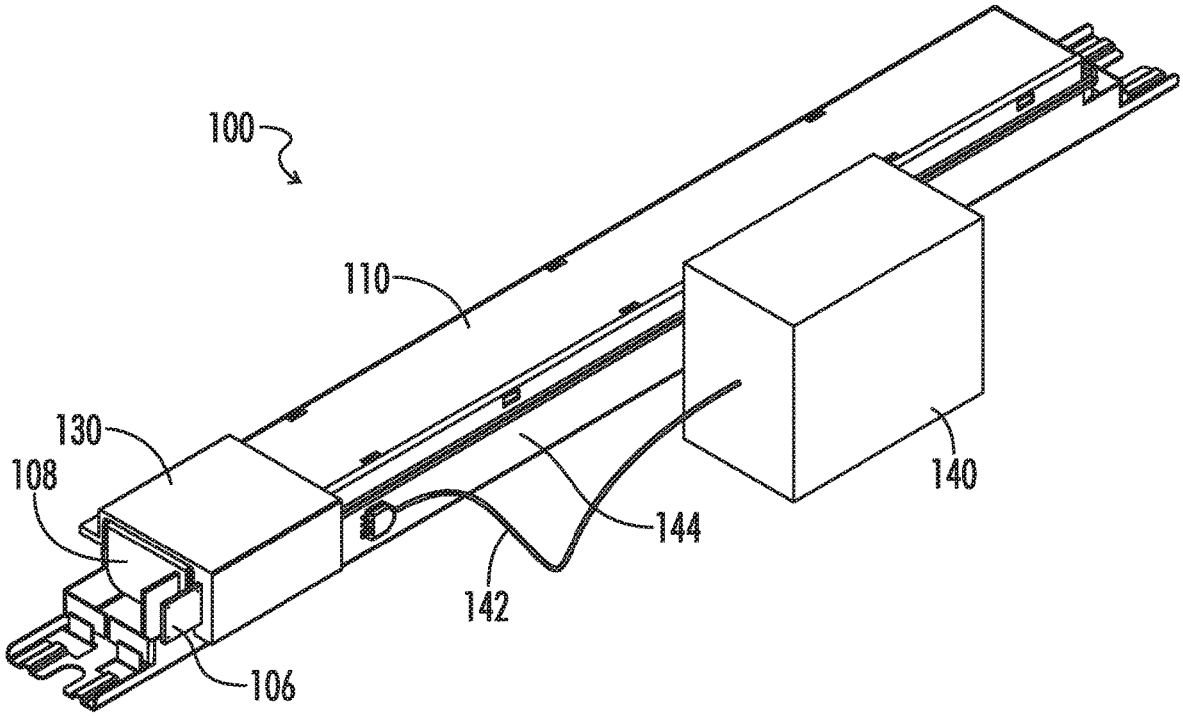
FIG. 7 is an isometric view of a digital control device mounted on a driving circuit employing a clip in accordance with an embodiment as disclosed herein.

Referring to an embodiment of the luminaire 100 as represented FIG. 7, a housing 130 for the digital control device is wrapped around the lid of a representative NFC equipped driver 110 so as to position the antenna 106 of the digital control device in a functional proximity and alignment with respect to the antenna 108 of the driving circuit. In this embodiment, power for the digital control device is derived from the output of the driver via conduit, leads, wires 144 or an equivalent thereof. Data from an external interface 140 is provided to the digital control device via wired connection 142.

Figure 8A:
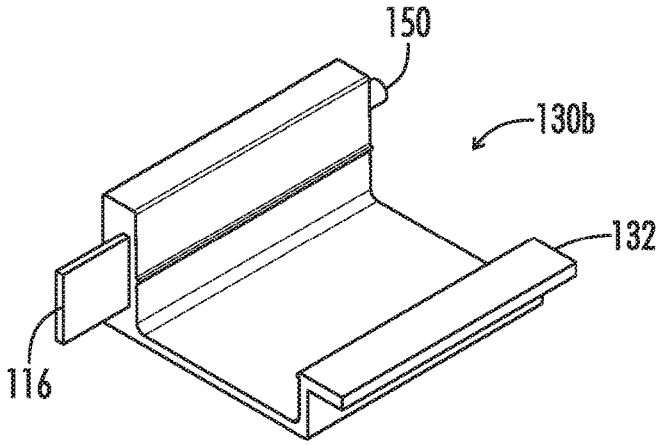
FIGS. 8*a* and 8*b* are separate isometric views of an exemplary digital control device housing with an RF interface.
Figure 8B:
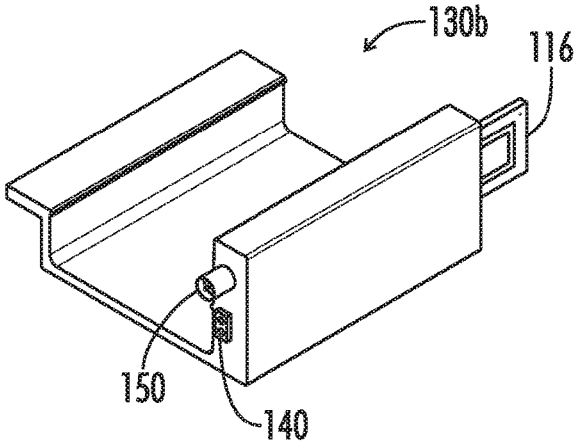

Referring next to FIGS. 8*a* and 8*b*, an embodiment of the housing 130*b* for the digital control device is illustrated with an RF connector 150 to which an external antenna would connect so as to take advantage of wireless interfaces, such as WI-FI, Bluetooth, Zigbee, etc. An input power connection 140 is further provided proximate thereto.

Figure 9:
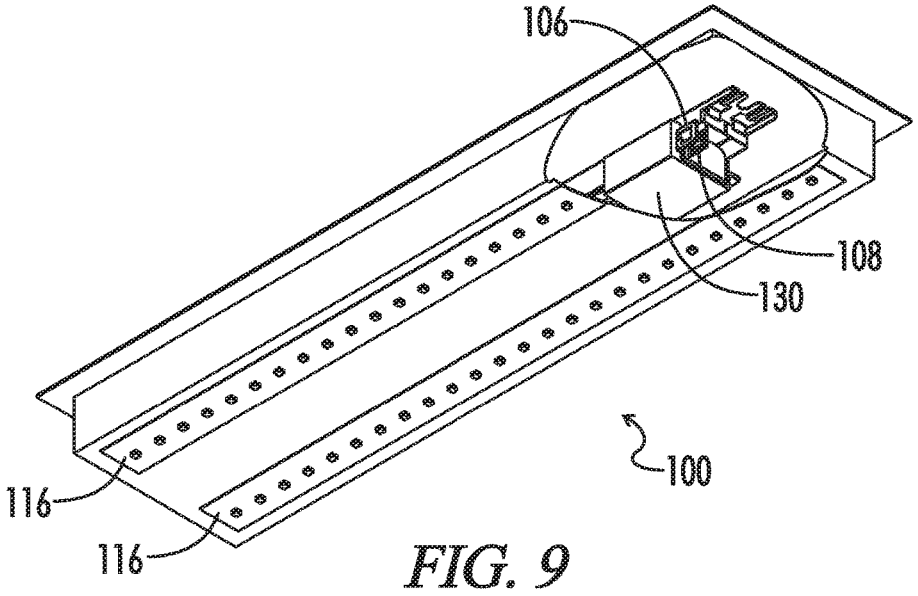
FIG. 9 is an isometric view of a luminaire comprising a digital control device mounted on an associated NFC-equipped LED driver so as to properly align their respective antennae, according to an embodiment as disclosed herein.

In an embodiment of the luminaire 100 as shown in FIG. 9, an embodiment of the housing 130 for the digital control device is mounted on an NFC equipped driver so as to functionally align the antenna 106 of the digital control device and the antenna 108 of the driving circuit. The light source 116 in this example comprises multiple lighting strips extending along a length of the luminaire surface and each including an array of LEDs.

Although a housing with a clip is illustrated and described above, a digital control device of the present invention is not necessarily limited thereto, and indeed a housing with a magnetic device or an adhesive strip could instead be employed. The clip is intended merely as one example of multiple possible methods, unless otherwise specifically stated or claimed.

Various embodiments as described herein show a digital control device with a wired interface, but the present invention is not necessarily limited thereto, and indeed would functional as well with a wireless interface via an antenna exiting the luminaire, unless otherwise specifically stated or claimed.

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may.

The term "coupled" means at least either a direct physical or electrical connection between the connected items or an indirect connection through one or more passive or active intermediary devices.

The term "circuit" means at least either a single component or a multiplicity of components, either active and/or passive, that are coupled together to provide a desired function.

Terms such as "wire," "wiring," "line," "signal," "conductor," and "bus" may be used to refer to any known structure, construction, arrangement, technique, method and/or process for physically transferring a signal from one point in a circuit to another. Also, unless indicated otherwise from the context of its use herein, the terms "known," "fixed," "given," "certain" and "predetermined" generally refer to a value, quantity, parameter, constraint, condition, state, process, procedure, method, practice, or combination thereof that is, in theory, variable, but is typically set in advance and not varied thereafter when in use.

The terms "power converter" and "converter" unless otherwise defined with respect to a particular element may be used interchangeably herein and with reference to at least DC-DC, DC-AC, AC-DC, buck, buck-boost, boost, half-bridge, full-bridge, H-bridge or various other forms of power conversion or inversion as known to one of skill in the art.

The term "controller" as used herein may refer to, be embodied by or otherwise included within a machine, such as a general purpose processor, a digital signal processor (DSP), an application specific integrated circuit (ASIC), a field programmable gate array (FPGA) or other programmable logic device, discrete gate or transistor logic, discrete hardware components, or any combination thereof designed and programmed to perform or cause the performance of the functions described herein. A general purpose processor can be a microprocessor, but in the alternative, the processor can be a microcontroller, or state machine, combinations of the same, or the like. A processor can also be implemented as a combination of computing devices, e.g., a combination of a DSP and a microprocessor, a plurality of microprocessors, one or more microprocessors in conjunction with a DSP core, or any other such configuration.

The various illustrative logical blocks, modules, and algorithm steps described in connection with the embodiments disclosed herein can be implemented as electronic hardware, computer software, or combinations of both. To clearly illustrate this interchangeability of hardware and software, various illustrative components, blocks, modules, and steps have been described above generally in terms of their functionality. Whether such functionality is implemented as hardware or software depends upon the particular application and design constraints imposed on the overall system. The described functionality can be implemented in varying ways for each particular application, but such implementation decisions should not be interpreted as causing a departure from the scope of the disclosure.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

The previous detailed description has been provided for the purposes of illustration and description. Thus, although there have been described particular embodiments of a new and useful invention, it is not intended that such references be construed as limitations upon the scope of this invention except as set forth in the following claims.

What is claimed is:

1. A luminaire comprising:

a driving circuit configured to convert AC mains input power into an output current for driving a lighting load, and comprising a first antenna;

a digital control device comprising a second antenna and mounted wherein the second antenna is positioned in operable proximity with the first antenna; and a first controller associated with the driving circuit and configured to generate output current reference signals for regulating the output current from the driving circuit, said output current reference signals corresponding to device configuration data;

the digital control device further comprising:

a first transceiver circuit coupled to one or more input terminals to communicate with an external device, a second transceiver circuit coupled to the second antenna and comprising a volatile memory interface configured to store the device configuration data, and a second controller configured to process device configuration data received from the external device for selective storage in volatile memory of the second transceiver circuit, wherein the first controller is configured to receive the device configuration data from the second transceiver circuit via the volatile memory interface and the operably linked first and second antennae, and wherein the second controller is configured to process reply data received from the first controller via the volatile memory interface for selective transmittal to the external device.

2. The luminaire of claim 1, wherein the digital control device comprises a housing detachably mounted in association with the luminaire, the second antenna positioned in operable proximity with the first antenna.

3. The luminaire of claim 2, wherein the housing of the digital control device comprises at least a fitted portion corresponding to at least a portion of a housing for the driving circuit, wherein upon engagement of the respective portions the first and second antennae are positioned in operable proximity.

4. The luminaire of claim 1, wherein the digital control device further comprises a power converter coupled to one or more input power terminals and configured to supply output power to the one or more transceiver circuits and the second controller.

5. The luminaire of claim 4, wherein the driving circuit and the power converter of the digital control device are configured to share mains input power.

6. The luminaire of claim 4, wherein the driving circuit and the power converter of the digital control device are configured to share input power from an auxiliary power supply.

7. The luminaire of claim 4, wherein the power converter of the digital control device is configured to receive a lighting load driving current from the driving circuit.

8. The luminaire of claim 4, wherein the first and second transceiver circuits and the second controller are configured to transfer and receive device configuration data in a bidirectional negotiation with the external device.

9. The luminaire of claim 4, wherein the first and second transceiver circuits and the second controller are configured to receive push updates of configurable parameters associated with the device configuration data from the external device.

10. The luminaire of claim 4, wherein the first and second transceiver circuits and the second controller are configured to transmit to the external device real time diagnostic and/or power reporting data received from the driving circuit via the operably linked antennae and stored via the volatile memory interface.

11. A method for providing isolated digital control for a luminaire comprising a light emitting diode (LED) driver having a first antenna, the method comprising:

mounting a digital control device comprising a second antenna wherein the second antenna is positioned in operable proximity with the first antenna;

delivering device configuration data from an external device to the digital control device, wherein the device configuration data is received and stored in a volatile memory interface associated with the digital control device;

selectively delivering at least a portion of the device configuration data from the digital control device to a controller associated with the LED driver via the operably linked first and second antennae;

processing reply data received from the LED driver via the operably linked first and second antennae and stored in the volatile memory, for selective transmittal to the external device; and regulating an output current from the LED driver through an associated LED lighting load, based at least in part on the device configuration data.

12. The method of claim 11, comprising detachably mounting a housing for the digital control device in association with the luminaire and the LED driver, the second antenna positioned in operable proximity with the first antenna.

13. The method of claim 12, wherein the housing of the digital control device comprises at least a fitted portion corresponding to at least a portion of a housing for the driving circuit, wherein upon engagement of the respective portions the first and second antennae are positioned in operable proximity.

14. The method of claim 11, further comprising transferring and receiving device configuration data in a bidirectional negotiation with the external device.

15. The method of claim 11, further comprising receiving push updates of configurable parameters associated with the device configuration data from the external device.

16. The method of claim 11, further comprising transmitting to the external device real time diagnostic and/or power reporting data received from the LED driver via the operably linked antennae and stored via the volatile memory interface.

* * * * *